US012298115B2

(12) United States Patent
Rascon et al.

(10) Patent No.: US 12,298,115 B2
(45) Date of Patent: May 13, 2025

(54) VACUUM INSULATED WARHEAD

(71) Applicant: Raytheon Company, Arlington, VA (US)

(72) Inventors: John Rascon, Tucson, AZ (US); John Regis Leach, Tucson, AZ (US); Jonathan Charles French, Tucson, AZ (US); Manuel E. Gonzales, Tucson, AZ (US)

(73) Assignee: Raytheon Company, Arlington, VA (US)

( * ) Notice: Subject to any disclaimer, the term of this patent is extended or adjusted under 35 U.S.C. 154(b) by 0 days.

(21) Appl. No.: 18/471,828

(22) Filed: Sep. 21, 2023

(65) Prior Publication Data

US 2025/0102281 A1 Mar. 27, 2025

(51) Int. Cl.
*F42B 39/18* (2006.01)
*F42B 12/22* (2006.01)

(52) U.S. Cl.
CPC ..... *F42B 39/18* (2013.01); *F42B 12/22* (2013.01)

(58) Field of Classification Search
CPC ..... F42B 39/18; F42B 12/22
See application file for complete search history.

(56) References Cited

U.S. PATENT DOCUMENTS 3,152,548 A 10/1964 Schwartz
3,776,201 A * 12/1973 Sabet ..... F01C 1/063 60/303
3,992,997 A 11/1976 Mccubbin et al.
4,041,869 A 8/1977 San
6,162,403 A * 12/2000 Foster ..... F01N 13/146 422/177
6,408,760 B1 * 6/2002 Knaresboro ..... F02K 9/18 102/288
6,935,594 B1 8/2005 Vaidyanathan et al.
7,886,667 B1 2/2011 Baker et al.
8,302,768 B2 * 11/2012 Sibley ..... F42B 39/22 89/34
8,689,669 B2 * 4/2014 Ronn ..... F42B 33/00 86/53
9,109,864 B2 * 8/2015 Beckman ..... F42B 12/52
9,423,223 B2 * 8/2016 Beckman ..... F42B 15/01
9,708,227 B2 * 7/2017 Alven ..... B22F 3/1007
(Continued)

FOREIGN PATENT DOCUMENTS

FR 843734 7/1939

OTHER PUBLICATIONS

"U.S. Appl. No. 18/471,855, Notice of Allowance mailed Sep. 30, 2024", 8 pgs.

(Continued)

*Primary Examiner* — Michelle Clement
(74) *Attorney, Agent, or Firm* — Schwegman Lundberg & Woessner, P.A.

(57) ABSTRACT

A vacuum insulation layer is wrapped around the length of a warhead to thermally insulate the warhead from fire or aerodynamic heating. The vacuum insulation layer may be integrally formed into the warhead casing or provided as a sleeve that may be permanently or removably positioned about the warhead casing. The vacuum insulation layer is held under vacuum with a pressure of less than 25 Torr and a thermal conductivity Tcond_vac of less than one-third of the thermal conductivity of air Tcond_air.

20 Claims, 6 Drawing Sheets

(56) References Cited

U.S. PATENT DOCUMENTS

| | | | | |
|---|---|---|---|---|
| 9,778,003 | B2 * | 10/2017 | Beckman | F42B 12/36 |
| 9,828,303 | B1 * | 11/2017 | Gold | C06B 45/04 |
| 10,712,137 | B1 * | 7/2020 | McGowan | F42B 33/001 |
| 10,760,531 | B2 | 9/2020 | Brennan et al. | |
| 11,578,958 | B2 * | 2/2023 | Rastegar | F42B 10/38 |
| 11,867,487 | B1 * | 1/2024 | Wach | F42B 14/06 |
| 12,060,031 | B2 * | 8/2024 | Inoue | B01J 7/00 |
| 12,065,990 | B1 | 8/2024 | Rascon et al. | |
| 12,135,196 | B2 * | 11/2024 | Thuman | F42B 33/00 |
| 12,140,408 | B1 * | 11/2024 | Rascon | F42B 39/14 |
| 2007/0234921 | A1 | 10/2007 | Han et al. | |
| 2011/0056402 | A1 * | 3/2011 | Gustavsson | F42C 19/12 102/440 |
| 2019/0010095 | A1 | 1/2019 | Kim et al. | |
| 2023/0358519 | A1 * | 11/2023 | Thuman | F42B 33/001 |
| 2024/0240925 | A1 * | 7/2024 | Thuman | F42B 12/32 |

OTHER PUBLICATIONS

"International Application Serial No. PCT US2024 047325, International Search Report mailed Dec. 19, 2024", 4 pgs.
"International Application Serial No. PCT US2024 047325, Written Opinion mailed Dec. 19, 2024", 5 pgs.
"International Application Serial No. PCT US2024 047326, International Search Report mailed Dec. 23, 2024", 4 pgs.
"International Application Serial No. PCT US2024 047326, Written Opinion mailed Dec. 23, 2024", 5 pgs.

* cited by examiner

300

THERMAL CONDUCTIVITY

| | |
|---|---|
| ALUMINUM ALLOY | 1.9 2W/mk |
| AIR | 0.026 W/mK |
| VACUUM | 0.004 W/mK |

VACUUM INSULATED WARHEAD

BACKGROUND

Field

This disclosure relates to thermal insulation of warheads to counter the effects of heating such as through fires on or near the warhead or aerodynamic heating.

Description of the Related Art

Exposure to high temperatures can degrade or desensitize explosive material inside a warhead. The effects may be premature detonation or a degraded ability to controllably detonate the explosive material. Thermal insulation is placed around the warhead to protect the explosive material. Ideally, the thermal insulation would have minimal impact on weight, volume or performance of the warhead.

The warhead is typically subjected to a number of tests to ensure the thermal design. A "slow cook-off" test subjects the warhead to temperatures that may be associated with a fire close to the warhead such as might occur in a warehouse. A "fast cook-off" test subjects the warhead to temperatures that may be associated with a fire on the warhead such as might occur on a tarmac or carrier due to a fuel ignition. Lastly, "in flight" tests subject the warhead to temperatures that may be associated with launch and flight to target of the warhead. The warhead must pass all of the tests.

U.S. Pat. No. 3,992,997 entitled "Warhead Casing" discloses a warhead casing designed to protect the high explosive material therein from open fires or other sources of intense heat which might cause premature explosion of the warhead. The warhead casing is relieved throughout the greater part of its outer circumference and may be then counter-relieved over a slightly lesser distance. The relieved area is filled with an ablative (insulating) material covered by a protective intumescent coating, for example, of fire resistant, impregnated cloth. The insulating material may, for example, include granulated cork bonded with a synthetic resin binder, a carbonized asbestos or Teflon.

As shown in FIGS. 1A-1B, thermal insulation may be provided by positioning a warhead 100 inside an airframe of a missile, rocket, guided projectile, or the like and spaced from the airframe skin 102. Warhead 100 includes a casing 104 and explosive 106 positioned inside the casing. A conductive layer 108 such as Aluminum is wrapped around and spaced apart from both the casing 104 and the airframe skin 102 to form inner and outer air gaps 110 and 112 above and below the conductive layer 108. The sandwich of inner air gap 110, conductive layer 108 and outer air gap 112 forms an insulating layer 114 that serves to insulate warhead 100 from heating of the airframe skin 102 such as through fires on or near the warhead or aerodynamic heating.

Heat forms on airframe skin 102 due to a fire or aerodynamic drag. This heat radiates into outer air gap 112 energizing molecules in the air causing the molecules to bounce around and transfer heat to conductive layer 108. The heat is absorbed on an outer surface of conductive layer 108, which then propages to the inner air gap 110, which heats up and transfers heat to casing 104. The conductive layer 108 serves to block the hot excited molecules in the outer air gap 112 from directly impinging upon and heating casing 104. The effects is to slow heat transfer from the airframe skin 102 to casing 104. A metal material is used for the conductive layer 108 instead of an insulating material to address other concerns for missiles, rockets, guided projectiles or the like such as the ability to maintain physical integrity over a long life span.

SUMMARY

The following is a summary that provides a basic understanding of some aspects of the disclosure. This summary is not intended to identify key or critical elements of the disclosure or to delineate the scope of the disclosure. Its sole purpose is to present some concepts of the disclosure in a simplified form as a prelude to the more detailed description and the defining claims that are presented later.

The present disclosure provides an insulated warhead in which a vacuum insulation layer is wrapped around the length of the warhead. In different configurations, the vacuum insulation layer may reduce weight or volume occupied by the requisite thermal insulation. If the warhead produces a fragmentation pattern, the vacuum insulation layer has negligible impact on the fragmentation pattern or velocity of the fragments.

In an embodiment, the vacuum insulation layer is integrally formed into the warhead casing.

In an embodiment, the vacuum insulation layer is formed as a sleeve that fits over the warhead casing. The sleeve may be permanently fixed to the warhead or removable such as when only used for purposes of storing the warhead. The sleeve may be used with warhead casings formed of either metal or composite materials.

In an embodiment, the vacuum insulation layer is held under vacuum with a pressure of less than 25 Torr and a thermal conductivity Tcond_vac of less than one-third of the thermal conductivity of air Tcond_air. The vacuum may be a medium vacuum between 25 Torr and $10^{-3}$ Torr or a high vacuum between $10^{-3}$ Torr and $10^{-6}$ Torr. Tcond_vac may be less than one-fifth and achieve a value of approximately 1/6.6 that of Tcond_air.

These and other features and advantages of the disclosure will be apparent to those skilled in the art from the following detailed description of preferred embodiments, taken together with the accompanying drawings, in which:

DETAILED DESCRIPTION

In the present disclosure, a vacuum insulation layer is wrapped around the length of a warhead to thermally insulate the warhead from fire or aerodynamic heating. The vacuum insulation layer may be integrally formed into the warhead casing or provided as a sleeve that may be permanently or removably positioned about the warhead casing. The vacuum insulation layer is held under vacuum with a pressure of less than 25 Torr (assuming storage or operation of the warhead at sea level with a temperature of 25 degrees C.) and a thermal conductivity Tcond_vac of less than one-third of the thermal conductivity of air Tcond_air. In different configurations, the vacuum insulation layer may reduce weight or volume occupied by the requisite thermal insulation. If the warhead produces a fragmentation pattern, the vacuum insulation layer has negligible impact on the fragmentation pattern or velocity of the fragments.

Figure 2B:
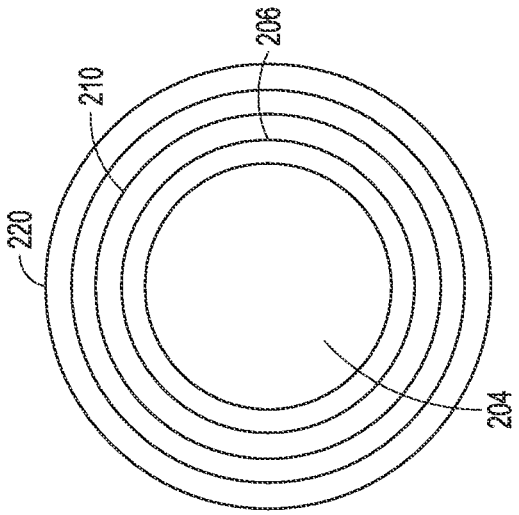
FIGS. 2A-2B are sectional and end views of an embodiment of a vacuum insulated warhead positioned inside an airframe of the weapon system.
Figure 2A:
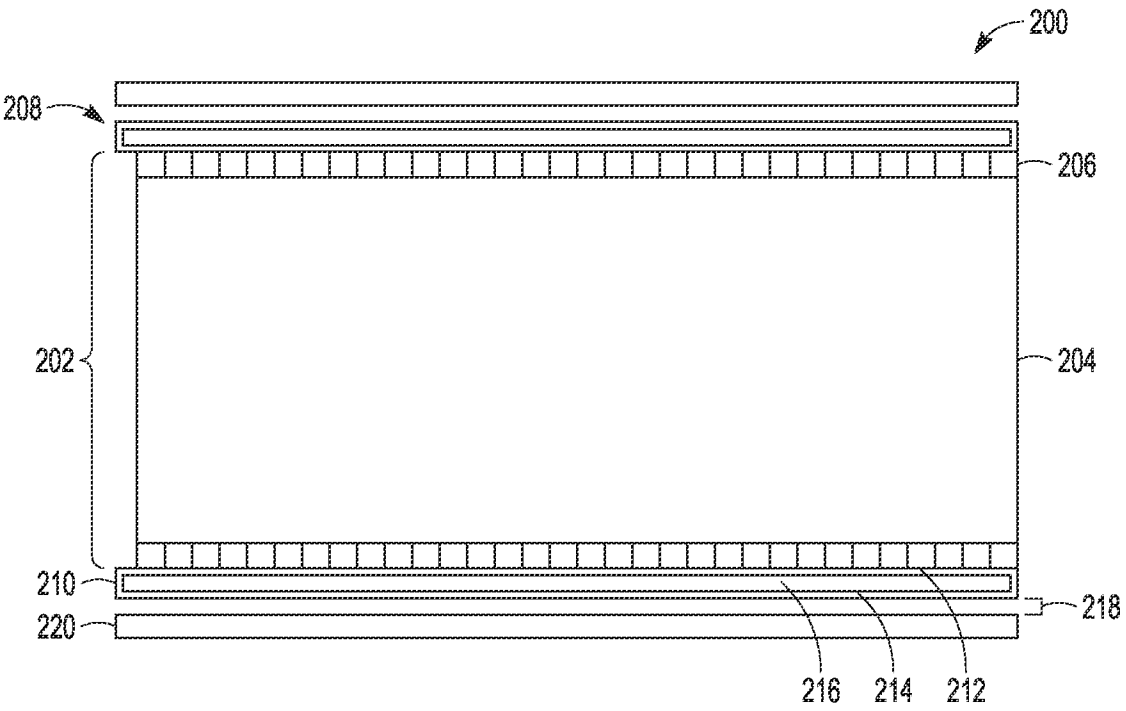

As shown in FIGS. 2A-2B, an embodiment of an insulated warhead 200 includes a warhead 202 in which an explosive material 204 is positioned inside a warhead casing 206 and a vacuum insulation layer 208 wrapped around a length of warhead 202.

A vacuum insulated casing 210 including inner and outer walls 212 and 214 defines an annular void space 216 around a length of the warhead casing 206 and explosive material 204. The annular void space 216 is sealed and held under vacuum with a pressure of less than 25 Torr (assuming storage or operation of the warhead at sea level with a temperature of 25 degrees C.) and a thermal conductivity Tcond_vac of less than one-third of the thermal conductivity of air Tcond_air to form vacuum insulation layer 208.

Figure 1B:
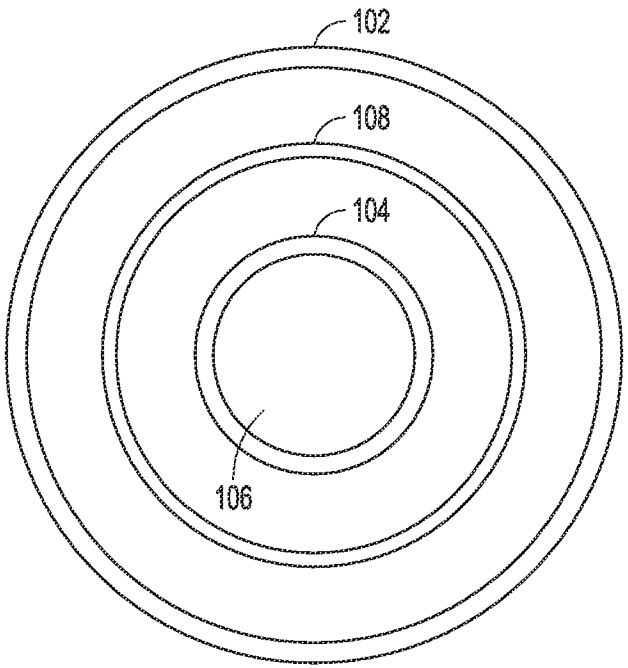
FIG. 1B (PRIOR ART)
FIGS. 1A-1B, as described above, are sectional and end views of an insulated warhead positioned inside an airframe of the weapon system.
Figure 1A:
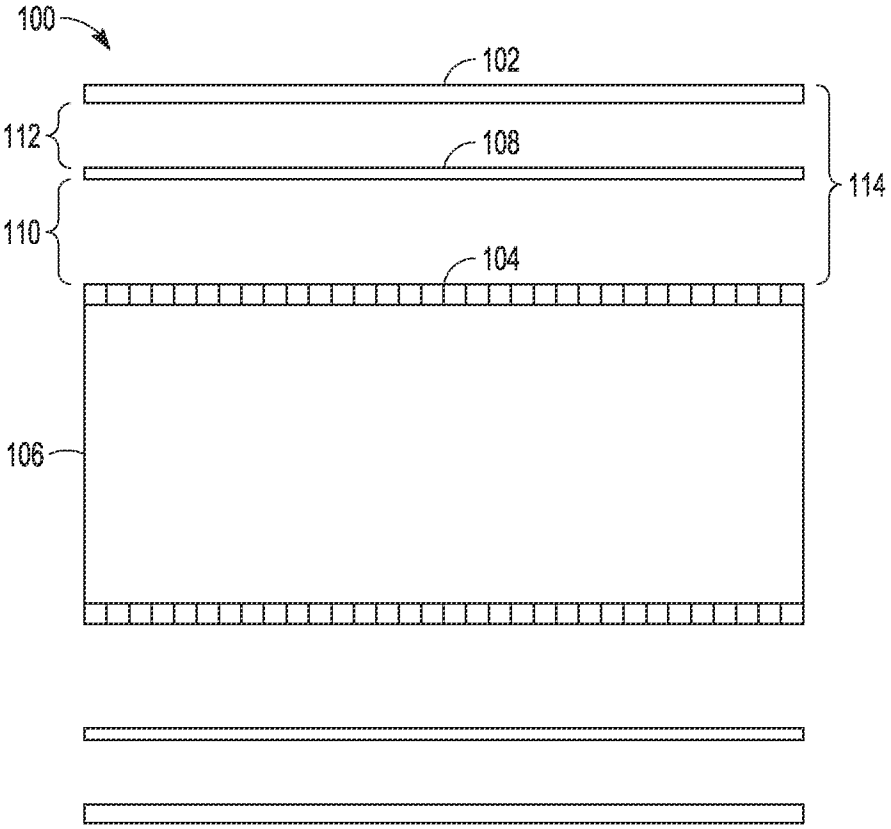
FIG. 1A (PRIOR ART)

In different embodiments, the vacuum may be a medium vacuum between 25 Torr and $10^{-3}$ Torr or a high vacuum between $10^{-3}$ Torr and $10^{-6}$ Torr. A higher vacuum (lower pressure) corresponds to less particles (contaminants) in the vacuum and thus a lower thermal conductivity. Tcond_vac may be less than one-fifth the Tcond_air and reach a limit of approximately 6.6× less than air. Vacuum insulation layer 208 can provide equivalent or better thermal insulation than the insulation layer (air gap/conductive layer/air gap) 114 shown in FIGS. 1A-1B with a far thinner layer. This may both reduce weight and occupied volume for the insulated warhead. As shown in FIG. 2A, when positioned within an air frame the requisite air gap 218 between the warhead 202 and airframe skin 220 need only be large enough for physical tolerances. The air gap 218 does not meaningfully contribute to the thermal insulation.

As will be discussed later, the vacuum insulation layer 208 may be integrally formed into the warhead casing 206 or provided as a sleeve that may be permanently or removably positioned about the warhead casing 206. For example, the sleeve may be used to provide thermal insulation and protection from fires during storage of certain warheads but removed when the warhead is assembled with the air frame or loaded in a launch system. The sleeve, which is formed from a material such as metal suitable to hold vacuum for long periods of time, may be used with a warhead casing of the same material or a different material such as in the case of a composite casing.

Figures 3A, 3B:
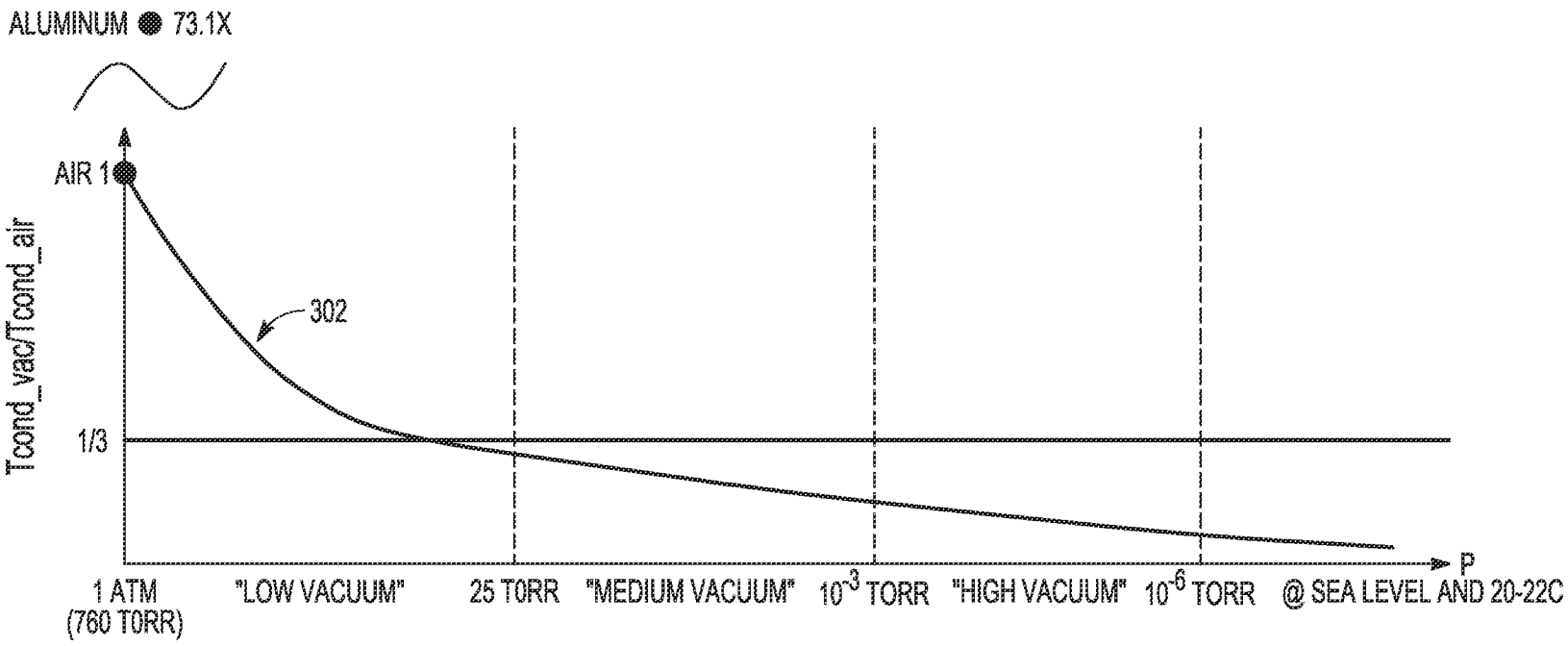
FIGS. 3A and 3B are a Table and plot of the relative thermal conductivity of a vacuum to air for low, medium and high vacuum.

Referring now to Table 300 of FIG. 3A and a plot 302 of the relative thermal conductivity of a vacuum to air in FIG. 3B, at sea level and a temperature of 25 C, air has a thermal conductivity of approximately 0.026 W/mK, aluminum of approximately 1.9 W/mK and a high vacuum of approximately 0.004 W/mK. As defined herein, a low vacuum is between 760 Torr (1 atm) and 25 (Torr), a medium vacuum between 25 Torr and $10^{-3}$ Torr or a high vacuum between $10^{-3}$ Torr and $10^{-6}$ Torr. Under low vacuum the difference in thermal conductivity with air is insufficient to provide the requisite thermal insulating benefits given the requirement to form and hold a vacuum. At medium and high vacuum, the thermal conductivity of the vacuum is less than 1/3, preferably less than 1/5 and ideally approximately 1/6.6 that of air. This provides a substantial thermal insulating benefit over an air gap or an insulating layer formed as an air gap/conductive layer/air gap.

Figure 4A:
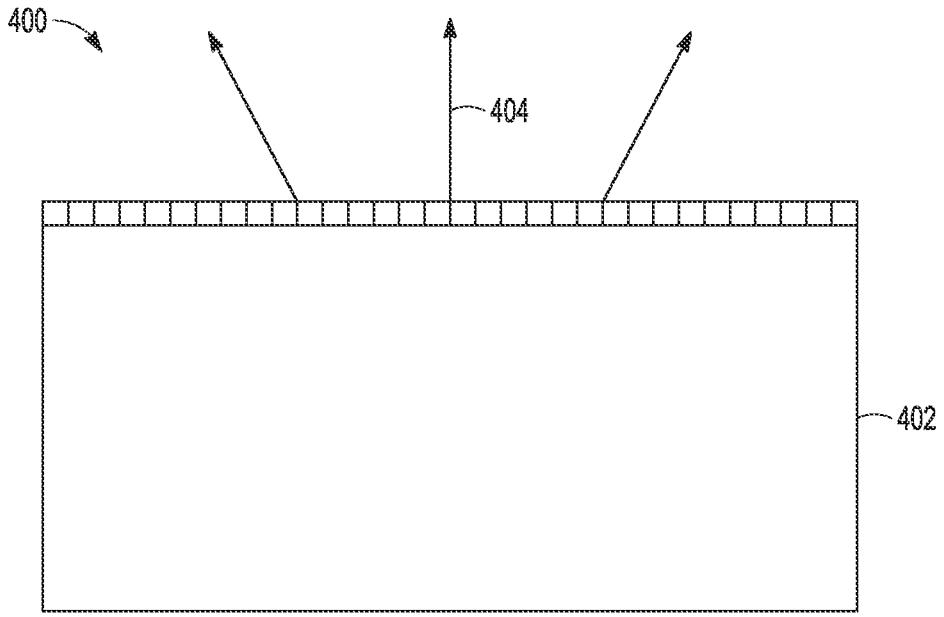
FIGS. 4A-4C are drawings depicting the effects on a warhead fragmentation pattern of different insulating techniques.
Figure 4B:
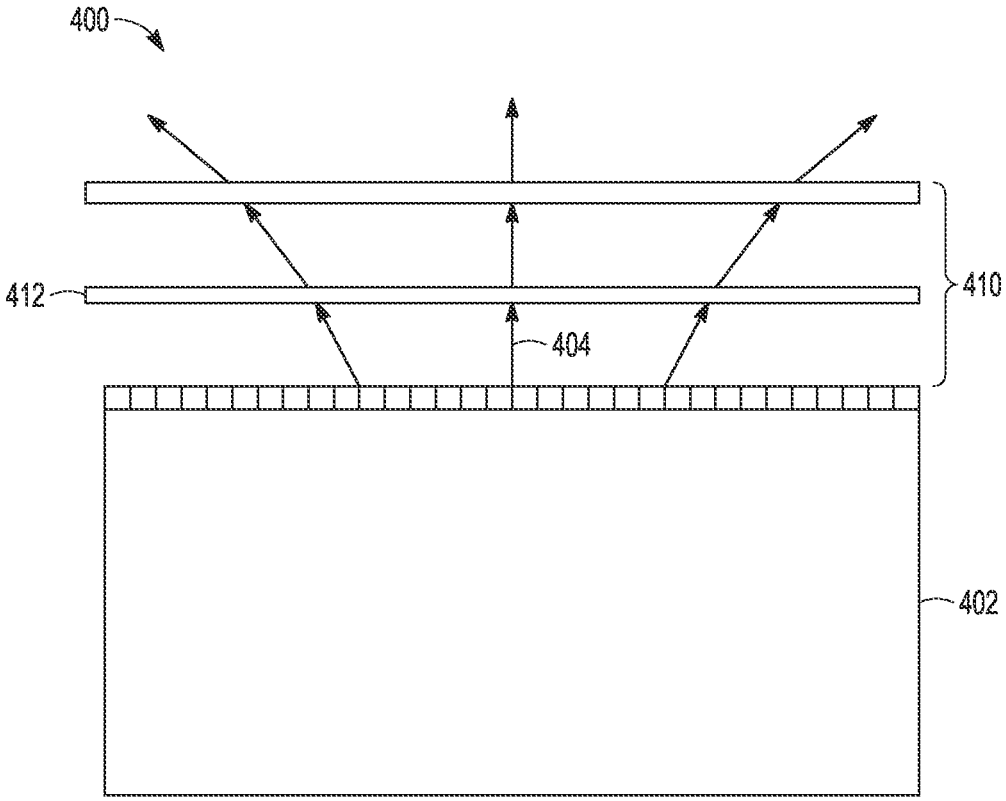
Figure 4C:
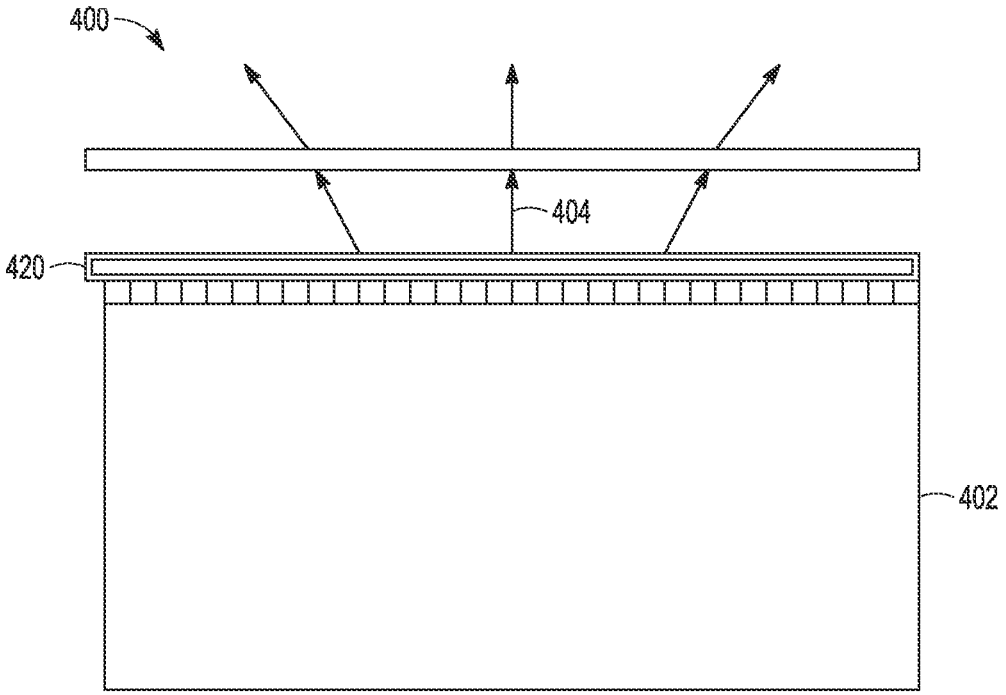

FIGS. 4A-4C illustrate a fragmentation pattern 400 for a fragmentation warhead 402 and the possible degradation of the fragmentation pattern in both the desired pattern and fragment velocity attendant to the different techniques for thermally insulating warhead 402. In this example, detonation of warhead 402 throws fragments 404 radially into a conic fragmentation pattern 400 at a desired fragment velocity. Any distortion of the pattern or slowing of the fragments is undesired.

Although not illustrated here, the layers of ablative (insulating material) and a protective intumescent coating formed in relieved areas of the warhead coating described in U.S. Pat. No. 3,992,997 will, upon detonation, tend to rip and tear and stick to fragments 404 thereby distorting the fragment pattern and reducing the velocity of the fragments.

As shown in FIG. 4B, the use of an insulating layer 410 formed as an air gap/conductive layer 412/air gap around warhead 402 will also degrade the fragment pattern and reduce fragment velocities. Upon detonation, conductive layer 412 will maintain physical integrity long enough to redirect and slow fragments 404.

As shown in FIG. 4C, the use of a vacuum insulating layer 420 around warhead 402 has minimal impact on fragmentation pattern 400. Upon detonation, the vacuum insulating layer 420 collapses and creates fragments that do not impact the fragmentation pattern 400.

Figure 5:
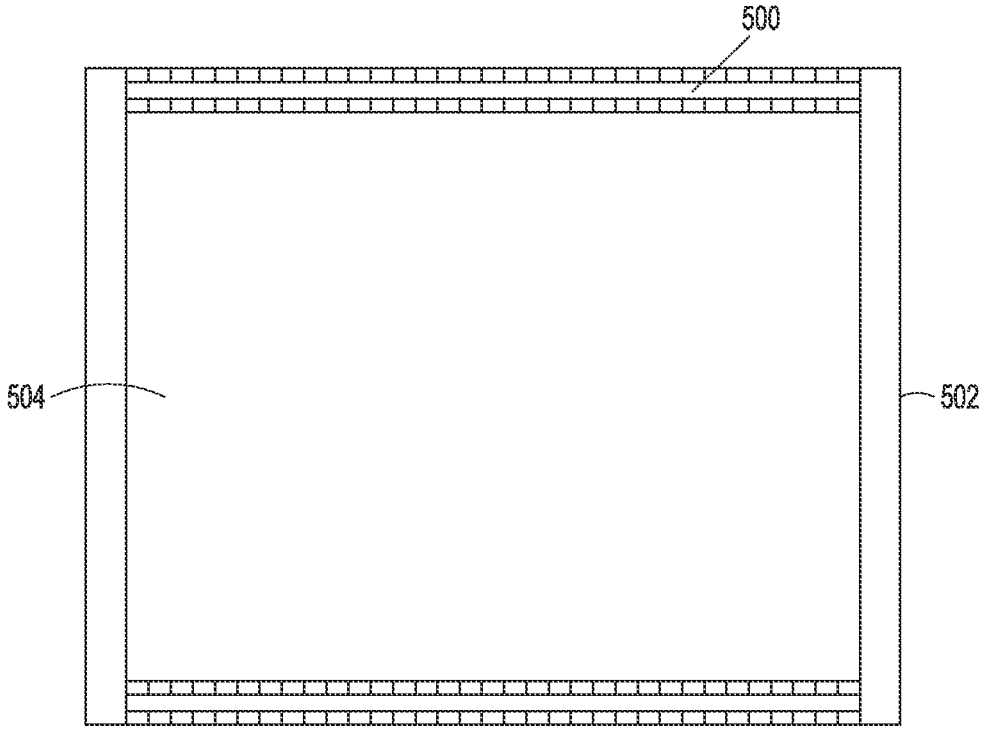
FIG. 5 is a drawing in which the vacuum insulation layer is integrated into the warhead casing.

As shown in FIG. 5, a vacuum insulating layer 500 is integrally formed in a warhead casing 502 that contains explosive 504. Warhead casing 502 must be formed of a material, typically metals such as titanium, steel or aluminum, on which sufficient vacuum can be pulled and sustained for the life of the warhead, or at least until the warheads are inspected and maintained.

Figure 6:
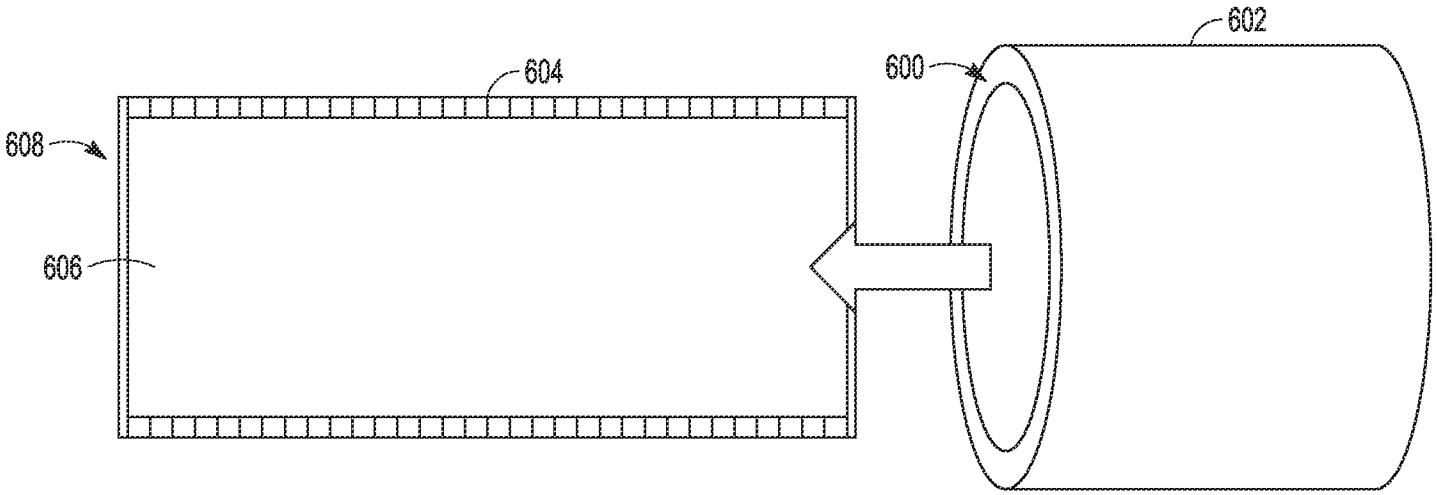
FIG. 6 is a drawing in which the vacuum insulation layer is provided as a sleeve that is either permanently or removably fitted over the warhead casing.

As shown in FIG. 6, a vacuum insulating layer 600 is integrally formed in a sleeve 602, which fits over the warhead casing 604 that contains explosive 606 to form a warhead 608. Sleeve 602 may be permanently or removably positioned about the warhead casing 604. For example, the sleeve may be used to provide thermal insulation and protection from fires during storage of certain warheads but removed when the warhead is assembled with the air frame or loaded in a launch system. Or the sleeve may be positioned over warhead 608 and then assembled into an airframe. The sleeve 602, which is formed from a material such as metal suitable to hold vacuum for long periods of time, may be used with a warhead casing of the same material or a different material such as in the case of a composite casing.

While several illustrative embodiments of the disclosure have been shown and described, numerous variations and alternate embodiments will occur to those skilled in the art. Such variations and alternate embodiments are contemplated, and can be made without departing from the spirit and scope of the disclosure as defined in the appended claims.

We claim:

1. A warhead, comprising:

an explosive material positioned inside a warhead casing; and a vacuum insulated casing including inner and outer walls defining an annular void space around a length of the warhead casing and explosive material, wherein the annular void space is held under vacuum with a pressure of less than 25 Torr and a thermal conductivity Tcond_vac of less than one-third of the thermal conductivity of air Tcond_air to form a vacuum insulation layer around the length of the warhead casing and explosive material.

2. The warhead of claim 1, wherein the pressure in the void space is a medium vacuum between 25 Torr and $10^{-3}$ Torr.

3. The warhead of claim 1, wherein the pressure in the void space is a high vacuum between $10^{-3}$ Torr and $10^{-6}$ Torr.

4. The warhead of claim 1, wherein Tcond_vac is less than one-fifth Tcond_air.

5. The warhead of claim 1, wherein Tcond_vac is approximately 1/6.6 that of Tcond_air.

6. The warhead of claim 1, wherein the warhead casing is formed of a metal material and the inner and outer walls are integrally formed with the warhead casing.

7. The warhead of claim 1, wherein the inner and outer walls are formed as a sleeve that fits over the warhead casing.

8. The warhead of claim 7, wherein the warhead casing wall is formed of a composite material.

9. The warhead of claim 7, wherein the sleeve is permanently affixed to the warhead casing.

10. The warhead of claim 7, wherein the sleeve is removable.

11. The warhead of claim 1, wherein the warhead casing is formed of a metal material that forms a fragmentation layer, which upon detonation of the explosive material fragments with the outer wall to form a fragmentation pattern.

12. A warhead, comprising:

an explosive material; and an integrally formed vacuum insulated metal warhead casing including an inner wall around a length of the explosive that forms a fragmentation layer and an outer wall that defines an annular void space, wherein the annular void space is held under vacuum with a pressure of less than 25 Torr and a thermal conductivity Tcond_vac of less than one-third of the thermal conductivity of air Tcond_air to form a vacuum insulation layer around the length of the warhead casing and explosive material.

13. The warhead of claim 12, wherein the pressure in the void space is a medium vacuum between 25 Torr and $10^{-3}$ Torr.

14. The warhead of claim 12, wherein the pressure in the void space is a high vacuum between $10^{-3}$ Torr and $10^{-6}$ Torr.

15. The warhead of claim 12, wherein Tcond_vac is less than one-fifth Tcond_air.

16. The warhead of claim 12, wherein upon detonation of the explosive material the fragmentation layer and outer wall fragment to form a fragmentation pattern.

17. A warhead, comprising:

an explosive material positioned inside a warhead casing; and a sleeve including inner and outer walls defining an annular void space that slides around the warhead casing and explosive material, wherein the annular void space is held under vacuum with a pressure of less than 25 Torr and a thermal conductivity Tcond_vac of less than one-third of the thermal conductivity of air Tcond_air to form a vacuum insulation layer around a length of the warhead casing and explosive material.

18. The warhead of claim 17, wherein the warhead casing wall is formed of a composite material.

19. The warhead of claim 17, wherein the sleeve is permanently affixed to the warhead casing.

20. The warhead of claim 17, wherein the sleeve is removable.

* * * * *